US007735639B1

(12) United States Patent
De Mare

(10) Patent No.: US 7,735,639 B1
(45) Date of Patent: Jun. 15, 2010

(54) EYEGLASSES HOLDER APPARATUS

(76) Inventor: John G. De Mare, 17012 Olde Mill Run, Derwood, MD (US) 20855

( * ) Notice: Subject to any disclaimer, the term of this patent is extended or adjusted under 35 U.S.C. 154(b) by 2 days.

(21) Appl. No.: 12/370,243

(22) Filed: Feb. 12, 2009

(51) Int. Cl.
*A45C 11/04* (2006.01)

(52) U.S. Cl. ..... 206/5; 211/10; 211/71.01; 211/81; 248/902; 248/149

(58) Field of Classification Search ..... 211/81, 211/85.17, 71.01, 74, 168, 85.18, 107, 196, 211/205, 10; 220/475; 206/5; 248/902, 248/457, 149, 128, 133, 136, 144, 130, 390.1, 248/314, 291.1, 292.12
See application file for complete search history.

(56) References Cited

U.S. PATENT DOCUMENTS 3,235,212 A * 2/1966 Baumiller, Jr. ..... 220/475
D229,976 S 1/1974 Zahn
4,946,125 A 8/1990 McCarty
5,188,322 A 2/1993 Kindtrey
5,568,872 A 10/1996 Hinnant, Jr.
5,577,611 A * 11/1996 Greenall ..... 206/459.1
5,791,460 A 8/1998 Fitzgerald et al.
5,921,409 A 7/1999 Gerber et al.
6,102,346 A 8/2000 Visser
6,116,412 A 9/2000 Rogers
6,273,386 B1 8/2001 Boeder
6,530,661 B1 3/2003 Vorhis
6,533,410 B1 * 3/2003 Shefler et al. ..... 206/5
7,243,450 B2 * 7/2007 Dicke et al. ..... 40/607.1

* cited by examiner

*Primary Examiner*—Ehud Gartenberg
*Assistant Examiner*—Andrew Perreault
(74) *Attorney, Agent, or Firm*—Crossley Patent Law; Mark Ashley Crossley

(57) ABSTRACT

The eyeglass holder apparatus provides a softly lined open-topped container for eyeglass storage. A pair of rods and a base with selectively employed adhesive supports the container. The rods are joined by a ratchet hinge that allows angular positioning of the first rod and container with regard to the second rod and the base, thereby providing further user convenience. Additionally, three pouches are affixed to the container and provide removable storage for moist towlettes, and various parts and tools used to maintain and repair glasses.

4 Claims, 5 Drawing Sheets

EYEGLASSES HOLDER APPARATUS

BACKGROUND OF THE INVENTION

Eyeglasses are often misplaced and damaged. For this reason, eyeglass holders have evolved. Some fit shirt or jacket pockets, while others are often carried in a car or purse, for example. Anyone who works at a desk or in an office is familiar with the problem. What has been needed is an eyeglass holder apparatus that not only protects glasses from being misplaced and damaged but also keeps them in a convenient holder that is conducive to use on a desk or other convenient surface. What has further been needed is such an apparatus that also stores supplies for eyeglasses, such as cleansing towlettes and repair kits with replacement screws and other useful accessories. The present apparatus provides for these needs.

FIELD OF THE INVENTION

The eyeglass holder apparatus relates to eyeglass holders and more especially to an eyeglass holder apparatus that also contains eyeglass supplies and provides ratcheted pivot of the container and attached pouches.

SUMMARY OF THE INVENTION

The general purpose of the eyeglass holder apparatus, described subsequently in greater detail, is to provide a eyeglass holder apparatus which has many novel features that result in an improved eyeglass holder apparatus which is not anticipated, rendered obvious, suggested, or even implied by prior art, either alone or in combination thereof.

To attain this, the eyeglass holder apparatus provides a softly lined open-topped container for eyeglass storage. A pair of rods and a base with selectively employed adhesive supports the container. The rods are joined by a ratchet hinge that allows angular positioning of the first rod and container with regard to the second rod and the base, thereby providing further convenience appreciated by users. Additionally, three pouches are affixed to the container and provide removable storage for moist towlettes, and various parts and tools used to maintain and repair glasses.

Thus has been broadly outlined the more important features of the improved eyeglass holder apparatus so that the detailed description thereof that follows may be better understood and in order that the present contribution to the art may be better appreciated.

An object of the eyeglass holder apparatus is to hold eyeglasses in a convenient, easily recognized and easily accessed container.

Another object of the eyeglass holder apparatus is to protect eyeglasses from damage and loss.

A further object of the eyeglass holder apparatus is to hold supplies used with eyeglasses.

An added object of the eyeglass holder apparatus is to provide selective pivot of the container for added convenience.

And, an object of the eyeglass holder apparatus is to provide for attachment of the apparatus to a chosen surface.

These together with additional objects, features and advantages of the improved eyeglass holder apparatus will be readily apparent to those of ordinary skill in the art upon reading the following detailed description of presently preferred, but nonetheless illustrative, embodiments of the improved eyeglass holder apparatus when taken in conjunction with the accompanying drawings.

In this respect, before explaining the current embodiments of the improved eyeglass holder apparatus in detail, it is to be understood that the eyeglass holder apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved eyeglass holder apparatus. It is therefore important that the claims be regarded as including such equivalent constructions insofar as they do not depart from the spirit and scope of the eyeglass holder apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the eyeglass holder apparatus generally designated by the reference number 10 will be described.

Figure 1:
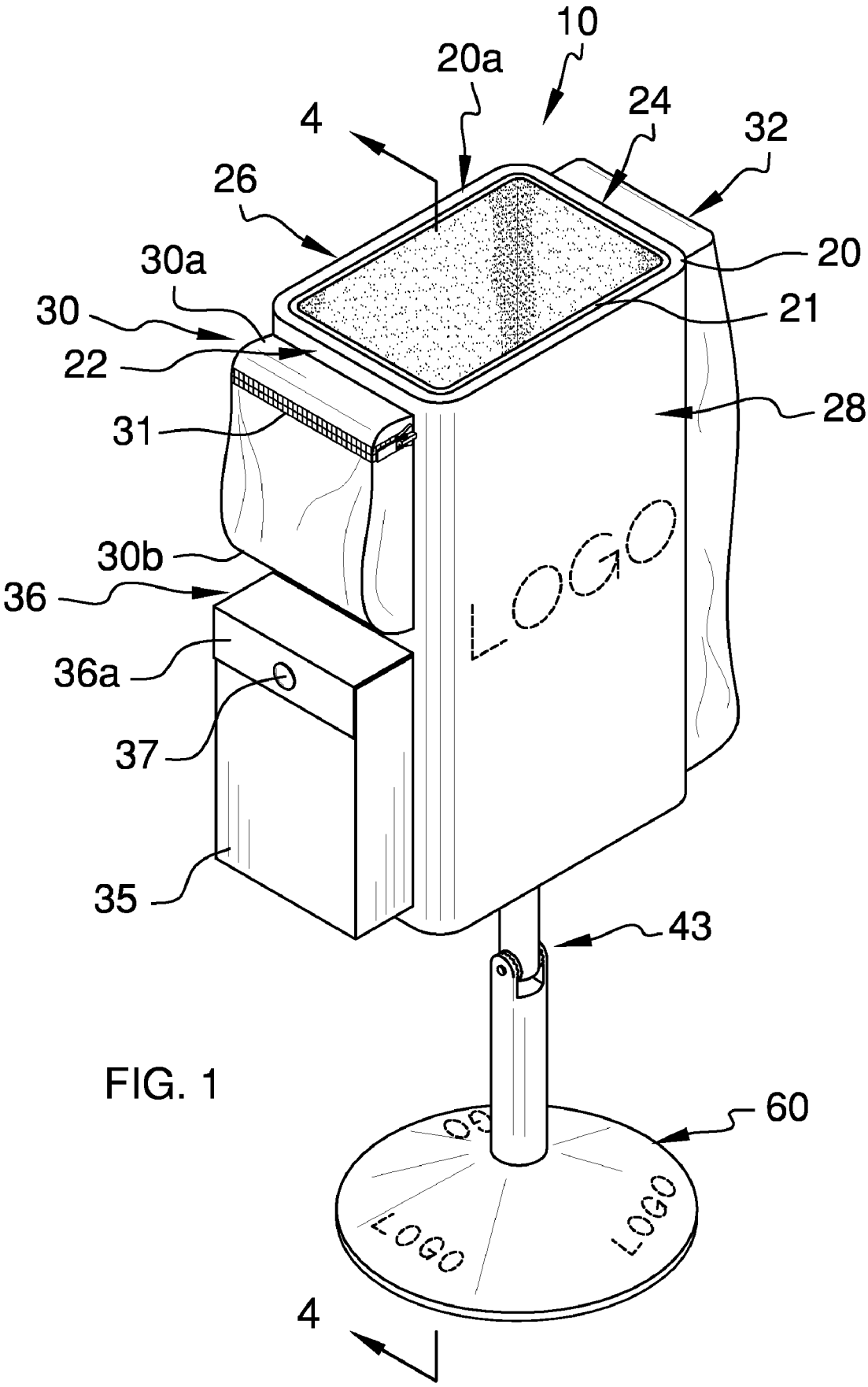
FIG. 1 is a perspective view.
Figure 2:
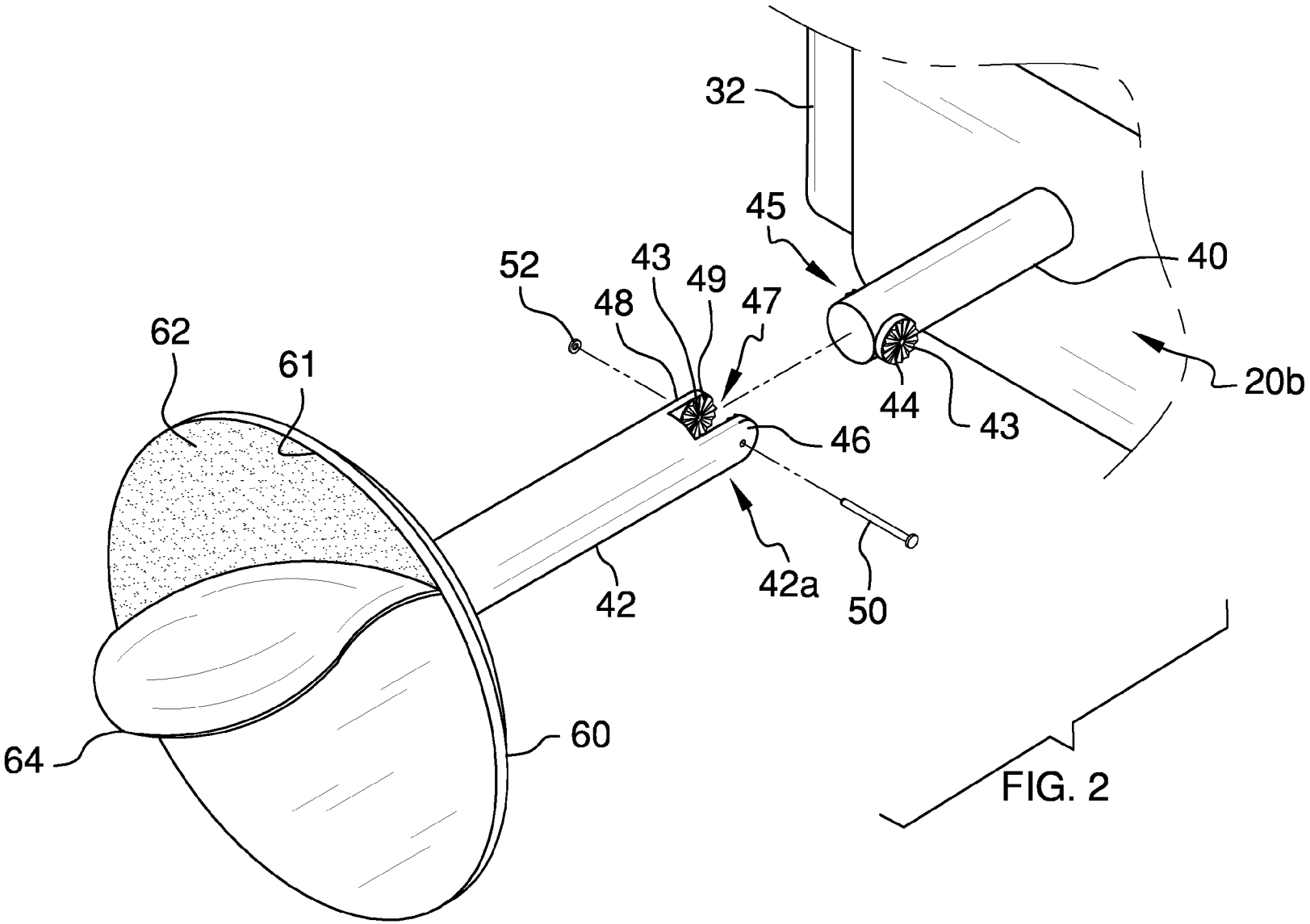
FIG. 2 is a perspective view of the base and ratchet hinge.

Referring to FIGS. 1 and 2, the eyeglass holder apparatus 10 partially comprises a rigid rectangular container 20 having an open container top 20*a* spaced apart from a closed container bottom 20*b*. The first side 22 is spaced apart from the second side 24. The third side 26 is spaced apart from the fourth side 28. The soft liner 21 us disposed within the entirety of the container 20. The pliable first pouch 30 is affixed to the container 20 first side 22. The first pouch 30 has a first pouch top 30*a* spaced apart from a first pouch bottom 30*b*. The first zipper 31 selectively opens the first pouch 30 proximal to the first pouch top 30*a*. The rigid pouch 35 is affixed to the container 20 first side 22 below the pliable first pouch 30. The pouch lid 36 is pivotally disposed for opening and closing atop the rigid pouch 35. The lid overlap 36*a* is attached to the pouch lid 36 and extends partially down an exterior length of the rigid pouch 35. The lid fastener 37 selectively secures the lid overlap 36*a* to the rigid pouch 35.

Figure 3:
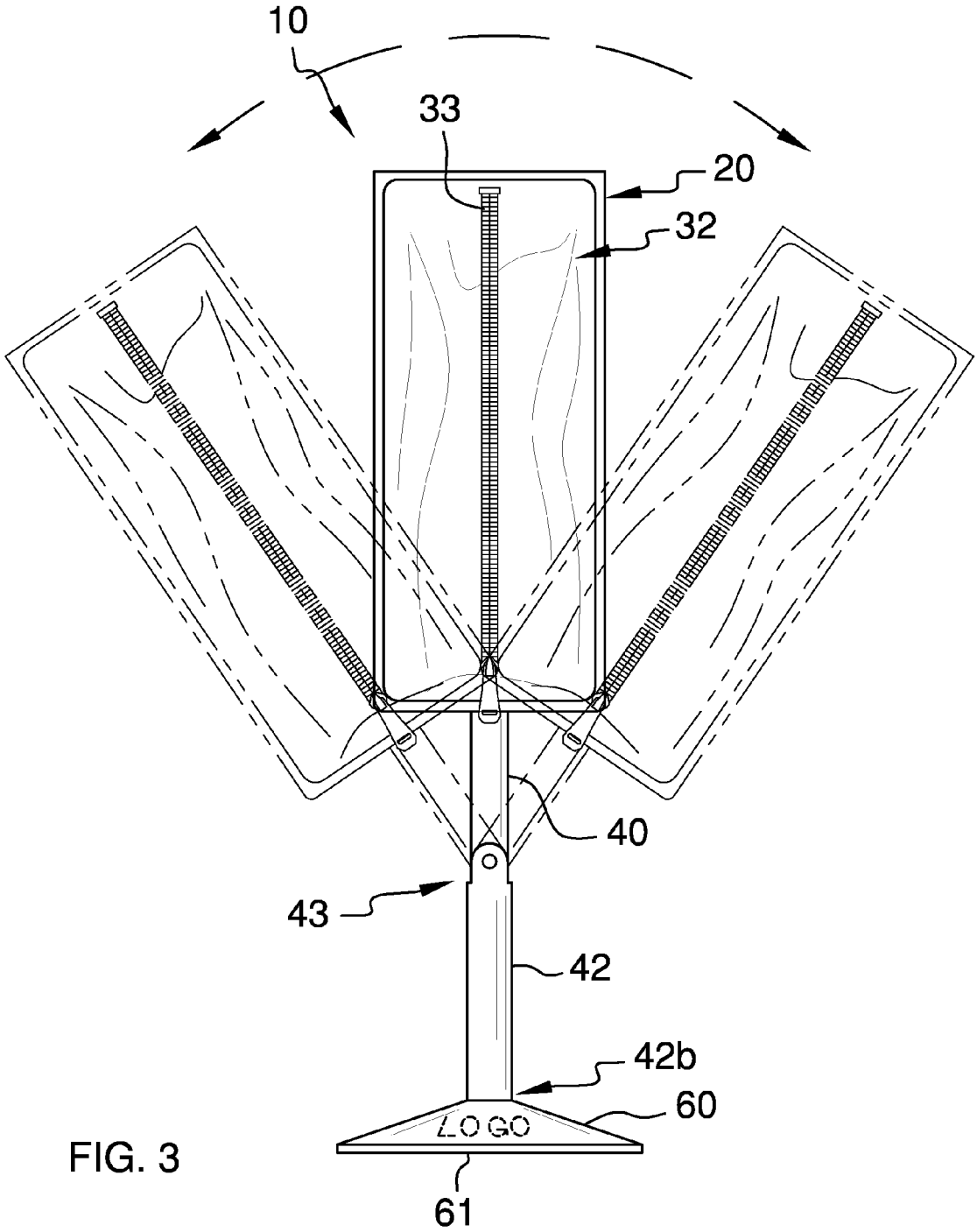
FIG. 3 is a lateral elevation view featuring the second pouch and ratchet hinge function.
Figure 4:
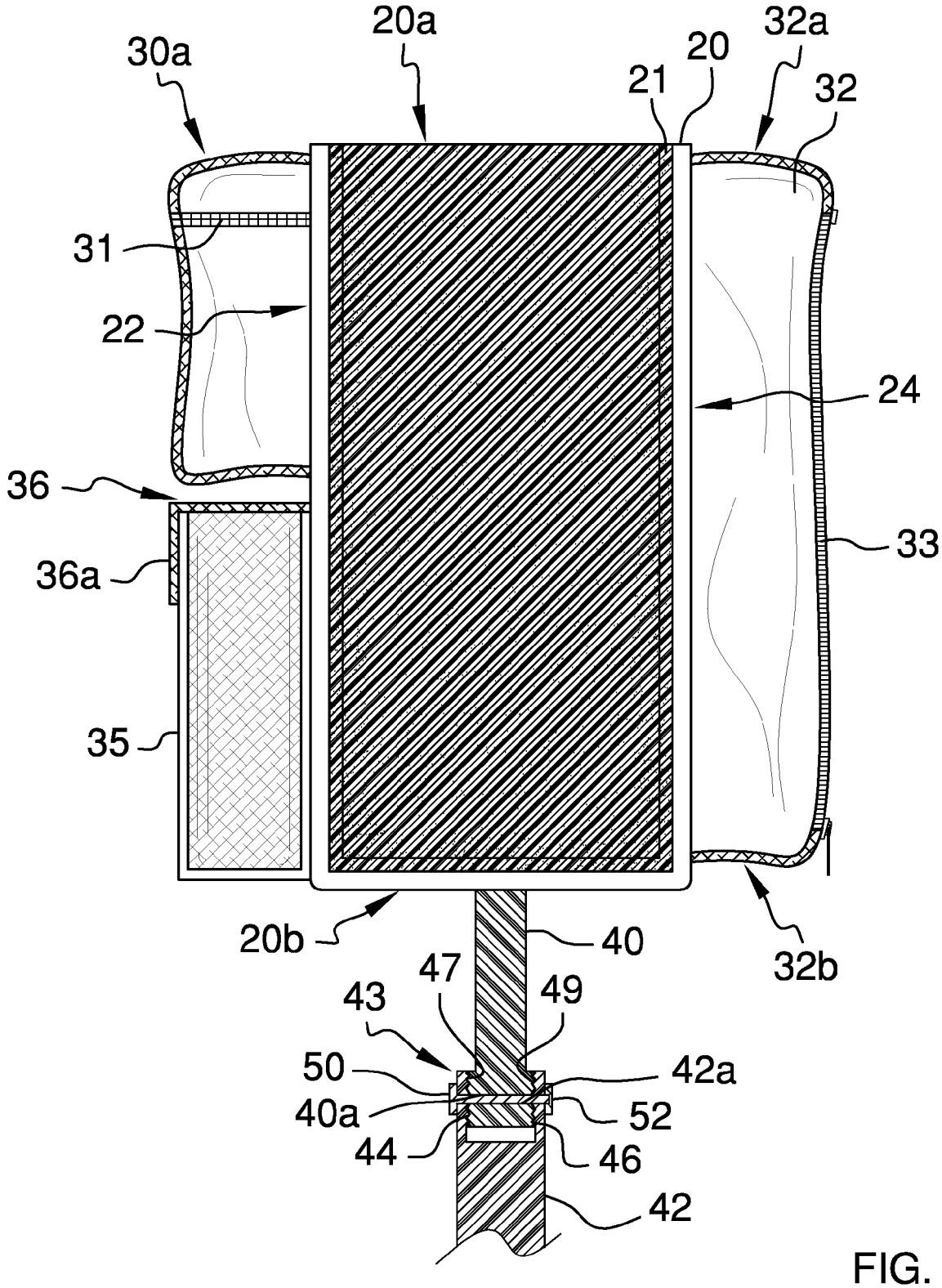
FIG. 4 is a cross sectional view of the container, attached pouches and ratchet hinge.
Figure 5:
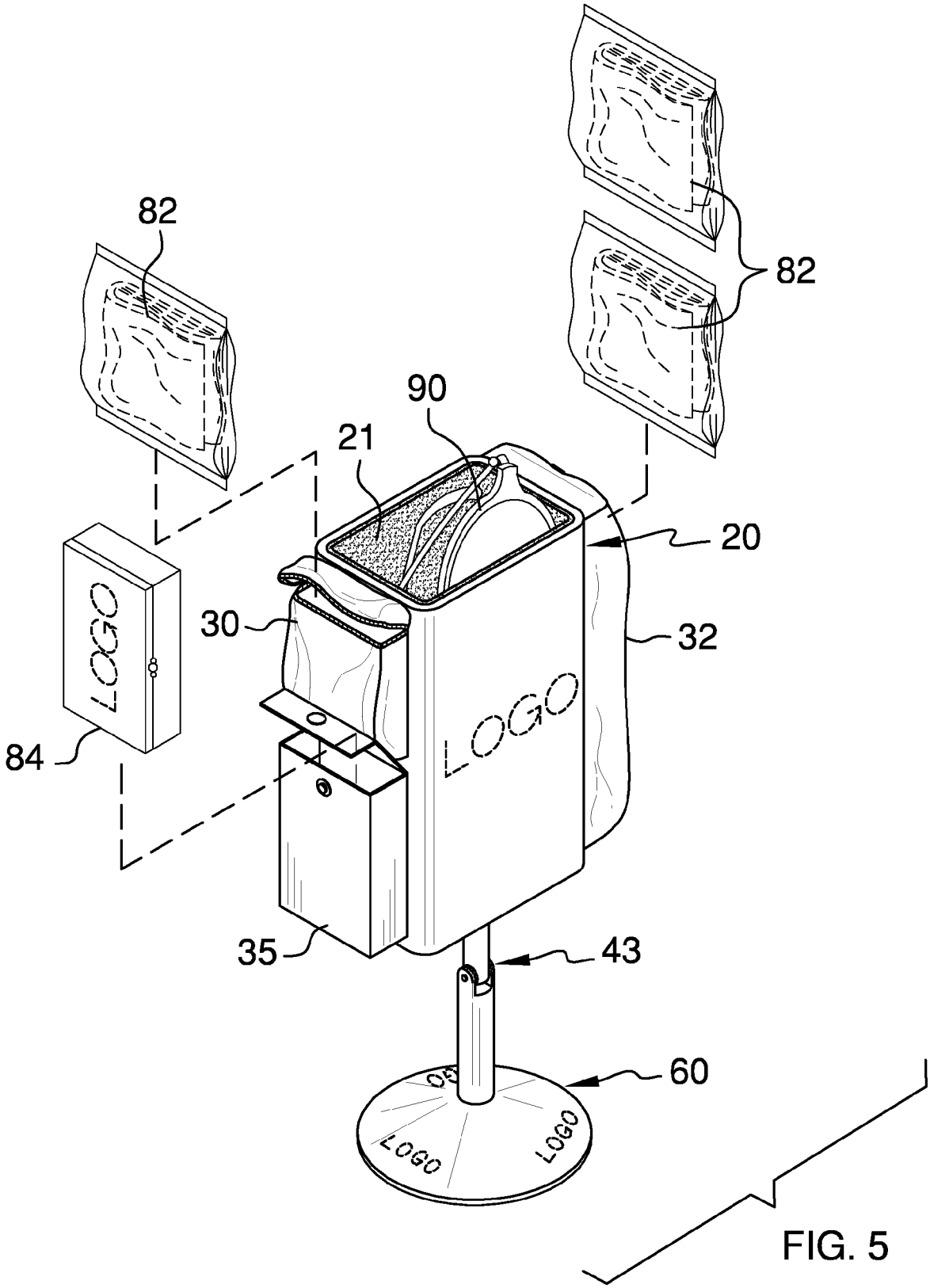
FIG. 5 is a perspective view with eyeglasses held within the container and towlettes and repair kit removed from the pouches.

Referring also to FIGS. 3 and 4, the pliable second pouch 32 is disposed on the container 20 second side 24. The second pouch 32 has a second pouch top 32*a* spaced apart from a second pouch bottom 32*b*. The second pouch 32 substantially covers the container 20 second side 24. The second zipper 33 selectively opens the second pouch 32. The second zipper 33 extends along a substantial length of the second pouch 32. The initial actuation of the second zipper 33 is proximal to the second pouch bottom 32*b* and provides best access to items within.

Referring again to FIGS. 2, 3, and 4, the first rod 40 extends downwardly from the container bottom 20*b*. The first rod 40 is disposed in about a middle of the container bottom 20*b*. The second rod 42 is disposed below the first rod 40. A ratchet hinge 43 connects the first rod 40 and second rod 42. The ratchet hinge 43 comprises a pair of diametrically disposed lateral ratchet faces adjacent to the first rod bottom 40*a*. The lateral ratchet faces comprise the first lateral ratchet face 44 and the second lateral ratchet face 45. A pair of ears is disposed oppositely and laterally at the second rod top 42*a*. The ears comprise the first ear 46 and the second ear 48. The first medial ratchet face 47 is disposed inwardly on the first ear 46. The second medial ratchet face 49 is disposed inwardly on the second ear 48. The lateral ratchet faces of the first rod 40 are fitted between the medial ratchet faces of the second rod 42. The first rod 40 is selectively and pivotally positioned above the second rod 42 by the ratchet hinge 43, thereby allowing the container top 20*a* to face angularly as desired, importantly providing added convenience to a user. A pin 50 passed through the ratchet faces pivotally affixes the ratchet faces. The adjustable tension retainer 52 secures the pin 50 to positionally secure the ratchet hinge pivoted position as desired.

Referring to FIG. 5 and again to FIGS. 2 and 3, the conical round base 60 is affixed to the second rod bottom 42*b*. An adhesive 62 is affixed to the base bottom 61 of the conical round base 60. An adhesive cover 64 is removably affixed to the adhesive 64.

Referring again to FIG. 5, the repair kit 84 is selectively held within the rigid pouch 35. A plurality of foil packed towlettes 82 is selectively held within the first pouch 30 and within the second pouch 32. Existing eyeglasses are selectively held within the container 20.

With respect to the above description then, it is to be realized that the optimum dimensional relationships for the parts of the eyeglass holder apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the eyeglass holder apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the eyeglass holder apparatus may be used.

Therefore, the foregoing is considered as illustrative only of the principles of the eyeglass holder apparatus. Further, since numerous modifications and changes will readily occur to those skilled in the art, it is not desired to limit the eyeglass holder apparatus to the exact construction and operation shown and described, and accordingly, all suitable modifications and equivalents may be resorted to, falling within the scope of the eyeglass holder apparatus.

What is claimed is:

1. An eyeglass holder apparatus, comprising, in combination:

a rigid rectangular container having an open container top spaced apart from a closed container bottom, a first side spaced apart from a second side, a third side spaced apart from a fourth side;

a soft liner within the container, the container in selective receipt of existing eyeglasses;

a first pouch affixed to the container first side, the first pouch having a first pouch top spaced apart from a first pouch bottom;

a first zipper selectively opening the first pouch proximal to the first pouch top;

a rigid pouch affixed to the container first side, below the first pouch;

a pouch lid pivotally atop the rigid pouch;

a lid overlap attached to the pouch lid, the overlap extended partially down an exterior length of the rigid pouch;

a lid fastener selectively securing the lid overlap to the rigid pouch;

a second pouch disposed on the container second side, the second pouch having a second pouch top spaced apart from a second pouch bottom;

a second zipper selectively opening the second pouch, the second zipper extended along a substantial length of the second pouch;

a first rod extended downwardly from the container bottom, the first rod disposed in about a middle of the container bottom;

a second rod disposed below the first rod, the first rod and second rod connected by a ratchet hinge, the ratchet hinge providing selected pivotal adjustment of the first rod relative to the second rod;

a conical round base affixed to a second rod bottom;

an adhesive affixed to a base bottom of the conical round base;

an adhesive cover removably affixed to the adhesive;

a repair kit selectively held within the rigid pouch;

a plurality of foil packed towlettes selectively held within the first pouch;

a plurality of foil packed towlettes selectively held within the second pouch.

2. The apparatus according to claim 1 wherein the second pouch further substantially covers the container second side.

3. The apparatus according to claim 2 wherein the second zipper further comprises an initial actuation proximal to the second pouch bottom.

4. An eyeglass holder apparatus, comprising, in combination:

a rigid rectangular container having an open container top spaced apart from a closed container bottom, a first side spaced apart from a second side, a third side spaced apart from a fourth side;

a soft liner within the container, the container in selective receipt of existing eyeglasses;

a pliable first pouch affixed to the container first side, the first pouch having a first pouch top spaced apart from a first pouch bottom;

a first zipper selectively opening the first pouch proximal to the first pouch top;

a rigid pouch affixed to the container first side, below the pliable first pouch;

a pouch lid pivotally atop the rigid pouch;

a lid overlap attached to the pouch lid, the overlap extended partially down an exterior length of the rigid pouch;

a lid fastener selectively securing the lid overlap to the rigid pouch;

a pliable second pouch disposed on the container second side, the second pouch having a second pouch top spaced apart from a second pouch bottom, the second pouch substantially covering the container second side;

a second zipper selectively opening the second pouch, the second zipper extended along a substantial length of the second pouch, an initial actuation of the second zipper proximal to the second pouch bottom;

a first rod extended downwardly from the container bottom, the first rod disposed in about a middle of the container bottom;

a second rod disposed below the first rod, the first rod and second rod connected by a ratchet hinge, the ratchet hinge providing selected pivotal adjustment of the first rod relative to the second rod, the ratchet hinge comprising:

a pair of lateral ratchet faces diametrically disposed laterally adjacent to a first rod bottom, comprising a first lateral ratchet face and a second lateral ratchet face;

a pair of ears disposed oppositely and laterally at a top of the second rod, the ears comprising first ear and a second ear;

a first medial ratchet face disposed inwardly on the first ear;

a second medial ratchet face disposed inwardly on the second ear, the lateral ratchet faces of the first rod fitted between the medial ratchet faces of the second rod, the rods selectively and pivotally positioned by the ratchet hinge, the ratchet hinge pivotally and adjustably affixed by a pin passed through the ratchet faces, the pin passed through the ears, the pin selectively secured by an adjustable tension retainer;

a conical round base affixed to a second rod bottom;

an adhesive affixed to a base bottom of the conical round base;

an adhesive cover removably affixed to the adhesive;

a repair kit selectively held within the rigid pouch;

a plurality of foil packed towlettes selectively held within the first pouch;

a plurality of foil packed towlettes selectively held within the second pouch.

* * * * *